US006239395B1

(12) United States Patent
Rosen

(10) Patent No.: US 6,239,395 B1
(45) Date of Patent: May 29, 2001

(54) AUXILIARY POSITION SWITCH ASSEMBLY FOR A CIRCUIT BREAKER

(75) Inventor: James L. Rosen, West Hartford, CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/418,263

(22) Filed: Oct. 14, 1999

(51) Int. Cl.[7] ..... H01H 67/02

(52) U.S. Cl. ..... 200/559; 200/17 R; 335/132; 335/202

(58) Field of Search ..... 200/1 R, 17 R, 200/18, 6 R, 6 B, 1 B, 50.01, 50.32, 50.37, 400, 401, 500, 501, 573, 553, 558, 559, 329, 337, 338, 339; 335/132, 202

(56) References Cited

U.S. PATENT DOCUMENTS

| | | | |
|---|---|---|---|
| D. 367,265 | 2/1996 | Yamagata et al. | D13/160 |
| 2,340,682 | 2/1944 | Powell | 200/147 |
| 2,719,203 | 9/1955 | Gelzheiser et al. | 200/144 |
| 2,937,254 | 5/1960 | Ericson | 200/114 |
| 3,158,717 | 11/1964 | Jencks et al. | 200/116 |
| 3,162,739 | 12/1964 | Klein et al. | 200/88 |
| 3,197,582 | 7/1965 | Norden | 200/50 |
| 3,307,002 | 2/1967 | Cooper | 200/116 |
| 3,517,356 | 6/1970 | Hanafusa | 335/16 |
| 3,631,369 | 12/1971 | Menocal | 337/110 |
| 3,803,455 | 4/1974 | Willard | 317/33 SC |
| 3,883,781 | 5/1975 | Cotton | 317/14 R |
| 4,129,762 | 12/1978 | Bruchet | 200/153 G |
| 4,144,513 | 3/1979 | Shafer et al. | 335/46 |
| 4,158,119 | 6/1979 | Krakik | 200/240 |
| 4,165,453 | 8/1979 | Hennemann | 200/153 G |

(List continued on next page.)

FOREIGN PATENT DOCUMENTS

| | | | |
|---|---|---|---|
| 819 008 | 12/1974 | (BE) | H01H/83/14 |
| 897 691 | 2/1984 | (BE) | H01H/71/24 |
| 12 27 978 | 11/1966 | (DE) . | |
| 30 47 360 | 6/1982 | (DE) | H01H/85/20 |
| 38 02 184 | 8/1989 | (DE) | H01H/3/46 |
| 38 43 277 | 6/1990 | (DE) | H02H/3/08 |
| 44 19 240 | 1/1995 | (DE) | H01H/9/10 |
| 0 061 092 | 9/1982 | (EP) | G03G/5/14 |
| 0 064 906 | 11/1982 | (EP) | H01H/71/74 |
| 0 066 486 | 12/1982 | (EP) | H01H/71/52 |
| 0 076 719 | 4/1983 | (EP) | H01H/71/74 |
| 0 117 094 | 8/1984 | (EP) | H01H/71/10 |
| 0 140 761 | 5/1985 | (EP) | H01H/71/92 |
| 0 174 904 | 3/1986 | (EP) | H01H/1/20 |
| 0 196 241 | 10/1986 | (EP) | H01H/71/00 |

(List continued on next page.)

*Primary Examiner*—Michael Friedhofer
(74) *Attorney, Agent, or Firm*—Cantor Colburn LLP; Carl B. Horton

(57) ABSTRACT

An auxiliary position switch assembly for a circuit breaker provides an electrical signal to an external monitoring device indicative of the position of a pair of separable contacts of the circuit breaker. The auxiliary position switch assembly engages a rod that switches from a retracted and extended position in response to the opening and closing of the separable contacts of the circuit breaker. The switch assembly includes a switch having a pair of separable contacts and a plunger having one end engaging one of the contacts. The plunger slidably engages a concave upper engagement surface of a pivotally mounted actuator. The actuator includes a lower convex engagement surface that engages the rod. A biasing spring connected to the actuator urges the actuator against the rod during operation of the switch assembly. The switch provides a normally-open output or a normally closed-output depending upon the position of the plunger on the upper surface of the actuator for a specific position of the separable contacts of the circuit breaker.

22 Claims, 3 Drawing Sheets

U.S. PATENT DOCUMENTS

| | | | |
|---|---|---|---|
| 4,166,988 | 9/1979 | Ciarcia et al. | 335/9 |
| 4,220,934 | 9/1980 | Wafer et al. | 335/16 |
| 4,255,732 | 3/1981 | Wafer et al. | 335/16 |
| 4,259,651 | 3/1981 | Yamat | 335/16 |
| 4,263,492 | 4/1981 | Maier et al. | 200/288 |
| 4,276,527 | 6/1981 | Gerbert-Gaillard et al. | 335/39 |
| 4,297,663 | 10/1981 | Seymour et al. | 335/20 |
| 4,301,342 | 11/1981 | Castonguay et al. | 200/153 SC |
| 4,360,852 | 11/1982 | Gilmore | 361/98 |
| 4,368,444 | 1/1983 | Preuss et al. | 335/166 |
| 4,375,021 | 2/1983 | Pardini et al. | 200/147 B |
| 4,375,022 | 2/1983 | Daussin et al. | 200/148 R |
| 4,376,270 | 3/1983 | Staffen | 335/21 |
| 4,383,146 | 5/1983 | Bur | 200/17 R |
| 4,392,036 | 7/1983 | Troebel et al. | 200/322 |
| 4,393,283 | 7/1983 | Masuda | 200/51.09 |
| 4,401,872 | 8/1983 | Boichot-Castagne et al. | 200/153 G |
| 4,409,573 | 10/1983 | DiMarco et al. | 335/16 |
| 4,435,690 | 3/1984 | Link et al. | 335/37 |
| 4,467,297 | 8/1984 | Boichot-Castagne et al. | 335/8 |
| 4,468,645 | 8/1984 | Gerbert-Gaillard et al. | 335/42 |
| 4,470,027 | 9/1984 | Link et al. | 335/16 |
| 4,479,143 | 10/1984 | Watanabe et al. | 358/44 |
| 4,488,133 | 12/1984 | McClellan et al. | 335/16 |
| 4,492,941 | 1/1985 | Nagel | 335/13 |
| 4,541,032 | 9/1985 | Schwab | 361/331 |
| 4,546,224 | 10/1985 | Mostosi | 200/153 G |
| 4,550,360 | 10/1985 | Dougherty | 361/93 |
| 4,562,419 | 12/1985 | Preuss et al. | 335/195 |
| 4,589,052 | 5/1986 | Dougherty | 361/94 |
| 4,595,812 | 6/1986 | Tamaru et al. | 200/307 |
| 4,611,187 | 9/1986 | Banfi | 335/16 |
| 4,612,430 | 9/1986 | Sloan et al. | 200/327 |
| 4,616,198 | 10/1986 | Pardini | 335/16 |
| 4,622,444 | 11/1986 | Kandatsu et al. | 200/303 |
| 4,631,625 | 12/1986 | Alexander et al. | 361/94 |
| 4,642,431 | 2/1987 | Tedesco et al. | 200/153 G |
| 4,644,438 | 2/1987 | Puccinelli et al. | 361/75 |
| 4,649,247 | 3/1987 | Preuss et al. | 200/244 |
| 4,658,322 | 4/1987 | Rivera | 361/37 |
| 4,672,501 | 6/1987 | Bilac et al. | 361/96 |
| 4,675,481 | 6/1987 | Markowski et al. | 200/144 R |
| 4,682,264 | 7/1987 | Demeyer | 361/96 |
| 4,689,712 | 8/1987 | Demeyer | 361/96 |
| 4,694,373 | 9/1987 | Demeyer | 361/96 |
| 4,710,845 | 12/1987 | Demeyer | 361/96 |
| 4,717,985 | 1/1988 | Demeyer | 361/96 |
| 4,733,211 | 3/1988 | Castonguay et al. | 335/192 |
| 4,733,321 | 3/1988 | Lindeperg | 361/96 |
| 4,764,650 | 8/1988 | Bur et al. | 200/153 G |
| 4,768,007 | 8/1988 | Mertz et al. | 335/202 |
| 4,780,786 | 10/1988 | Weynachter et al. | 361/87 |
| 4,831,221 | 5/1989 | Yu et al. | 200/553 |
| 4,870,531 | 9/1989 | Danek | 361/93 |
| 4,883,931 | 11/1989 | Batteux et al. | 200/148 R |
| 4,884,047 | 11/1989 | Baginski et al. | 335/10 |
| 4,884,164 | 11/1989 | Dziura et al. | 361/97 |
| 4,900,882 | 2/1990 | Bernard et al. | 200/147 R |
| 4,910,485 | 3/1990 | Bolongeat-Mobleu et al. | 335/195 |
| 4,914,541 | 4/1990 | Tripodi et al. | 361/94 |
| 4,916,420 | 4/1990 | Bartolo et al. | 335/172 |
| 4,916,421 | 4/1990 | Pardini et al. | 335/185 |
| 4,926,282 | 5/1990 | McGhie | 361/102 |
| 4,935,590 | 6/1990 | Malkin et al. | 200/148 A |
| 4,937,706 | 6/1990 | Schueller et al. | 361/396 |
| 4,939,492 | 7/1990 | Raso et al. | 335/42 |
| 4,943,691 | 7/1990 | Mertz | 200/151 |
| 4,943,888 | 7/1990 | Jacob et al. | 361/96 |
| 4,950,855 | 8/1990 | Bolonegeat-Mobleu et al. | 200/148 A |
| 4,951,019 | 8/1990 | Gula | 335/166 |
| 4,952,897 | 8/1990 | Barnel et al. | 335/147 |
| 4,958,135 | 9/1990 | Baginski et al. | 335/8 |
| 4,965,543 | 10/1990 | Batteux | 335/174 |
| 4,983,788 | 1/1991 | Pardini | 200/16 R |
| 5,001,313 | 3/1991 | Leclerq et al. | 200/148 B |
| 5,004,878 | 4/1991 | Seymour et al. | 200/144 R |
| 5,029,301 | 7/1991 | Nebon et al. | 335/16 |
| 5,030,804 | 7/1991 | Abri | 200/323 |
| 5,057,655 | 10/1991 | Kersusan et al. | 200/148 B |
| 5,077,627 | 12/1991 | Fraisse | 361/93 |
| 5,083,081 | 1/1992 | Barrault et al. | 324/126 |
| 5,095,183 | 3/1992 | Raphard et al. | 200/148 A |
| 5,103,198 | 4/1992 | Morel et al. | 335/6 |
| 5,107,236 * | 4/1992 | Lesslie et al. | 335/132 |
| 5,115,371 | 5/1992 | Tripodi | 361/106 |
| 5,120,921 | 6/1992 | DiMarco et al. | 200/401 |
| 5,132,865 | 7/1992 | Mertz et al. | 361/6 |
| 5,138,121 | 8/1992 | Streich et al. | 200/293 |
| 5,140,115 | 8/1992 | Morris | 200/308 |
| 5,153,802 | 10/1992 | Mertz et al. | 361/18 |
| 5,155,315 | 10/1992 | Malkin et al. | 200/148 R |
| 5,166,483 | 11/1992 | Kersusan et al. | 200/144 A |
| 5,172,087 | 12/1992 | Castonguay et al. | 335/160 |
| 5,178,504 | 1/1993 | Falchi | 411/553 |
| 5,184,717 | 2/1993 | Chou et al. | 200/401 |
| 5,187,339 | 2/1993 | Lissandrin | 200/148 F |
| 5,198,956 | 3/1993 | Dvorak | 361/106 |
| 5,200,724 | 4/1993 | Gula et al. | 335/166 |
| 5,210,385 | 5/1993 | Morel et al. | 200/146 R |
| 5,223,813 * | 6/1993 | Cambreleng et al. | 337/66 |
| 5,239,150 | 8/1993 | Bolongeat-Mobleu et al. | 200/148 R |
| 5,260,533 | 11/1993 | Livesey et al. | 200/401 |
| 5,262,744 | 11/1993 | Arnold et al. | 335/8 |
| 5,280,144 | 1/1994 | Bolongeat-Mobleu et al. | 200/148 R |
| 5,281,776 | 1/1994 | Morel et al. | 200/144 |
| 5,296,660 | 3/1994 | Morel et al. | 200/146 R |
| 5,296,664 | 3/1994 | Crookston et al. | 200/401 |
| 5,298,874 | 3/1994 | Morel et al. | 335/8 |
| 5,300,907 | 4/1994 | Nereau et al. | 335/172 |
| 5,310,971 | 5/1994 | Vial et al. | 200/244 |
| 5,313,180 | 5/1994 | Vial et al. | 335/16 |
| 5,317,471 | 5/1994 | Izoard et al. | 361/105 |
| 5,331,500 | 7/1994 | Corcoles et al. | 361/93 |
| 5,334,808 | 8/1994 | Bur et al. | 200/50 |
| 5,341,191 | 8/1994 | Crookston et al. | 335/16 |
| 5,347,096 | 9/1994 | Bolongeat-Mobleu et al. | 200/148 B |
| 5,347,097 | 9/1994 | Bolongeat-Mobleu et al. | 200/148 B |
| 5,350,892 | 9/1994 | Rozier | 200/144 B |
| 5,357,066 | 10/1994 | Morel et al. | 200/17 R |
| 5,357,068 | 10/1994 | Rozier | 200/148 R |
| 5,357,394 | 10/1994 | Piney | 361/72 |
| 5,361,052 | 11/1994 | Ferullo et al. | 335/172 |
| 5,373,130 | 12/1994 | Barrault et al. | 200/147 R |
| 5,379,013 | 1/1995 | Coudert | 335/17 |
| 5,424,701 | 6/1995 | Castonguary et al. | 335/172 |
| 5,438,176 | 8/1995 | Bonnardel et al. | 200/400 |
| 5,440,088 | 8/1995 | Coudert et al. | 200/303 |
| 5,449,871 | 9/1995 | Batteux et al. | 200/401 |
| 5,450,048 | 9/1995 | Leger et al. | 335/132 |
| 5,451,729 | 9/1995 | Onderka et al. | 200/18 |
| 5,457,295 | 10/1995 | Tanibe et al. | 200/293 |
| 5,467,069 | 11/1995 | Payet-Burin et al. | 335/42 |
| 5,469,121 | 11/1995 | Payet-Burin | 335/16 |
| 5,475,558 | 12/1995 | Barjonnet et al. | 361/64 |
| 5,477,016 | 12/1995 | Baginski et al. | 200/43.11 |
| 5,479,143 | 12/1995 | Payet-Burin | 335/202 |
| 5,483,212 | 1/1996 | Lankuttis et al. | 335/132 |
| 5,485,134 * | 1/1996 | Seymour et al. | 335/132 |
| 5,485,343 | 1/1996 | Santos et al. | 361/115 |
| 5,493,083 | 2/1996 | Olivier | 200/17 R |

| | | | | |
|---|---|---|---|---|
| 5,504,284 | | 4/1996 | Lazareth et al. | 200/50 R |
| 5,504,290 | | 4/1996 | Baginski et al. | 200/401 |
| 5,510,761 | | 4/1996 | Boder et al. | 335/172 |
| 5,512,720 | | 4/1996 | Coudert et al. | 200/400 |
| 5,515,018 | | 5/1996 | DiMarco et al. | 335/16 |
| 5,519,561 | | 5/1996 | Mrenna et al. | 361/105 |
| 5,534,674 | | 7/1996 | Steffens | 218/154 |
| 5,534,832 | | 7/1996 | Duchemin et al. | 335/16 |
| 5,534,835 | | 7/1996 | McColloch et al. | 335/172 |
| 5,534,840 | | 7/1996 | Cuingnet | 337/1 |
| 5,539,168 | | 7/1996 | Linzenich | 200/303 |
| 5,543,595 | | 8/1996 | Mader et al. | 200/401 |
| 5,552,755 | | 9/1996 | Fello et al. | 335/18 |
| 5,581,219 | | 12/1996 | Nozawa et al. | 335/132 |
| 5,604,656 | | 2/1997 | Derrick et al. | 361/187 |
| 5,608,367 | | 3/1997 | Zoller et al. | 335/132 |
| 5,784,233 | | 7/1998 | Bastard et al. | 361/36 |
| 5,836,441 | * | 11/1998 | Scheel et al. | 200/17 R |
| 5,969,587 | * | 10/1999 | Combas | 335/132 |
| 6,040,746 | * | 3/2000 | Maloney et al. | 335/13 |

FOREIGN PATENT DOCUMENTS

| | | | | |
|---|---|---|---|---|
| 0 224 396 | | 6/1987 | (EP) | H01H/71/52 |
| 0 235 479 | | 9/1987 | (EP) | H02H/3/04 |
| 0 239 460 | | 9/1987 | (EP) | H01H/33/24 |
| 0 258 090 | | 3/1988 | (EP) | H02H/7/22 |
| 0 264 313 | | 4/1988 | (EP) | H01H/83/04 |
| 0 264 314 | | 4/1988 | (EP) | H01H/83/00 |
| 0 283 189 | | 9/1988 | (EP) | H02B/13/02 |
| 0 283 358 | | 9/1988 | (EP) | H02H/3/10 |
| 0 291 374 | | 11/1988 | (EP) | H01H/83/20 |
| 0 295 155 | | 12/1988 | (EP) | H01H/83/20 |
| 0 295 158 | | 12/1988 | (EP) | H01H/71/52 |
| 0 309 923 | | 4/1989 | (EP) | H01H/77/10 |
| 0 313 106 | | 4/1989 | (EP) | H02B/13/02 |
| 0 313 422 | | 4/1989 | (EP) | H02H/1/00 |
| 0 314 540 | | 5/1989 | (EP) | H01H/1/20 |
| 0 331 586 | | 9/1989 | (EP) | H01H/83/20 |
| 0 337 900 | | 10/1989 | (EP) | H01H/71/32 |
| 0 342 133 | | 11/1989 | (EP) | H01H/71/50 |
| 0 367 690 | | 5/1990 | (EP) | H02H/3/04 |
| 0 371 887 | * | 6/1990 | (EP) | H01H/71/10 |
| 0 375 568 | * | 6/1990 | (EP) | H01H/71/02 |
| 0 394 144 | * | 10/1990 | (EP) | H01H/71/46 |
| 0 394 922 | * | 10/1990 | (EP) | H01H/1/20 |
| 0 399 282 | | 11/1990 | (EP) | H01H/73/04 |
| 0 407 310 | * | 1/1991 | (EP) | H02H/3/347 |
| 0 452 230 | * | 10/1991 | (EP) | H01H/71/50 |
| 0 555 158 | * | 8/1993 | (EP) | H01H/71/52 |
| 0 567 416 | * | 10/1993 | (EP) | H01H/9/26 |
| 0 595 730 | * | 5/1994 | (EP) | H01H/71/08 |
| 0 619 591 | * | 10/1994 | (EP) | H01H/71/40 |
| 0 665 569 | * | 8/1995 | (EP) | H01H/83/22 |
| 0 700 140 | * | 3/1996 | (EP) | H02H/3/33 |
| 0 889 498 | | 1/1999 | (EP) | H01H/73/04 |
| 2 410 353 | * | 6/1979 | (FR) | H01H/51/24 |
| 2 512 582 | * | 3/1983 | (FR) | H01H/9/20 |
| 2 553 943 | * | 4/1985 | (FR) | H02H/3/33 |
| 2 592 998 | * | 7/1987 | (FR) | H02H/3/10 |
| 2 682 531 | | 4/1993 | (FR) | H01H/71/10 |
| 2 697 670 | * | 5/1994 | (FR) | H01H/51/27 |
| 2 699 324 | * | 6/1994 | (FR) | H01H/71/10 |
| 2 714 771 | * | 7/1995 | (FR) | H02H/7/045 |
| 2 233 155 | | 1/1991 | (GB) | H01H/77/10 |
| 1 227 978 | | 4/1986 | (RU) | G01N/3/30 |
| 92/00598 | | 1/1992 | (WO) | H01H/1/50 |
| 92/05649 | | 4/1992 | (WO) | H04M/1/00 |
| 94/00901 | | 1/1994 | (WO) | H02H/5/04 |

* cited by examiner

AUXILIARY POSITION SWITCH ASSEMBLY FOR A CIRCUIT BREAKER

BACKGROUND OF THE INVENTION

This invention relates generally to an auxiliary switch for electrical power distribution interruption equipment and more particularly to an auxiliary position switch for electrical circuit breakers that provides a signal indicative of the position of the contacts of the circuit breaker.

Electrical circuit breakers are utilized throughout electrical power transmission and distribution systems to interrupt the flow of electric current to a protected load. A conventional circuit breaker includes a pair of separable contacts that open in response to a fault condition, e.g. overcurrent and ground fault, to interrupt the current flow. Auxiliary position switches are typically mounted to the frame of the circuit breaker to provide an electrical signal indicative of the position of the circuit breaker contacts.

A typical auxiliary switch includes a movable contact structure in which one contact is disposed at a stationary contact arm, while the other contact is disposed on a movable contact arm. A spring generally urges the movable contact arm about a pivot to position the movable contact arm in a normally open or normally closed state. A plunger engages the movable contact arm for opening the separable contacts in the normally closed configuration or for closing the separable contacts in the normally open configuration. When the plunger is depressed, it moves the movable contact arm to open or close the contacts accordingly.

Typically, a circuit breaker rod acts upon the plunger. The circuit breaker rod is mechanically linked to a movable contact arm of the circuit breaker to provide an indication of the position of the separable contacts (i.e., opened or closed). The circuit breaker rod is displaced upon rotation or displacement of the movable contact arm of the circuit breaker. The displacement of the circuit breaker rod in turn displaces the plunger of the auxiliary switch which provides an electrical signal to an external monitoring system indicative of the position of the contacts of the circuit breaker.

When using an auxiliary position switch with a circuit breaker, it is desirable to utilize a switch that does not exhibit contact bounce. Control circuits are sensitive and an intermittent breaker position signal could result in false signals. Auxiliary position switches that exhibit little or no contact bounce typically have been single action either normally open (N.O.) or normally closed (N.C.).

Depending upon the configuration of the external monitoring system, the configuration of auxiliary switch and the circuit breaker may be such that the auxiliary switch is normally open when the circuit breaker contacts are closed or normally open when the circuit breaker contacts are open. As one will appreciate, the configuration of the auxiliary switch (normally open and normally closed) is dependent upon the configuration of the circuit breaker and the external monitoring system. Accordingly, circuit breakers, including auxiliary switches, are provided for a number of configurations which require a number of auxiliary switches to be stocked for each configuration.

Circuit breakers may also be configured in the field. As a result of the number of different configurations for interconnecting the auxiliary switch to the external monitoring system, field personnel are required to carry a large inventory of auxiliary position switches of different types to provide the necessary configuration (i.e., normally open and normally closed) as described hereinabove. High inventories along with extensive preparation are, therefore, required for configuring auxiliary position switches.

BRIEF SUMMARY OF THE INVENTION

In an exemplary embodiment of the present invention, an auxiliary position switch assembly for a circuit breaker provides a signal representative of the position of a pair of separable contacts for interrupting current to a protected load. The circuit breaker has a rod that switches between a first and second position in accordance with the opening and closing of the separable contacts of the circuit breaker. The switch assembly includes a switch having first and second separable contacts. The switch selectively mounts in one of a first and second configuration. The switch assembly further includes a pivotally mounted actuator having a first and second engagement surface. The first separable contact of the switch that is disposed in the first configuration engages a first portion of the first engagement surface, and contacts a second portion of the first engagement surface when disposed in the second configuration. The rod engages the second engagement surface of the actuator for pivoting the actuator in accordance with the opening and closing of the separable contacts of the circuit breaker. A spring member is connected to the actuator for urging the actuator against the rod. When the switch is disposed in the first configuration, the actuator closes the first and second separable contacts of the switch in response to the rod disposed in the first position. When the switch is disposed in the second configuration, the actuator opens the first and second separable contacts of the switch in response to the rod disposed in the second position.

BRIEF SUMMARY OF THE DRAWINGS

Referring now to the drawings wherein like elements are numbered alike in the several Figures.

DETAILED DESCRIPTION OF THE INVENTION

Figure 1:
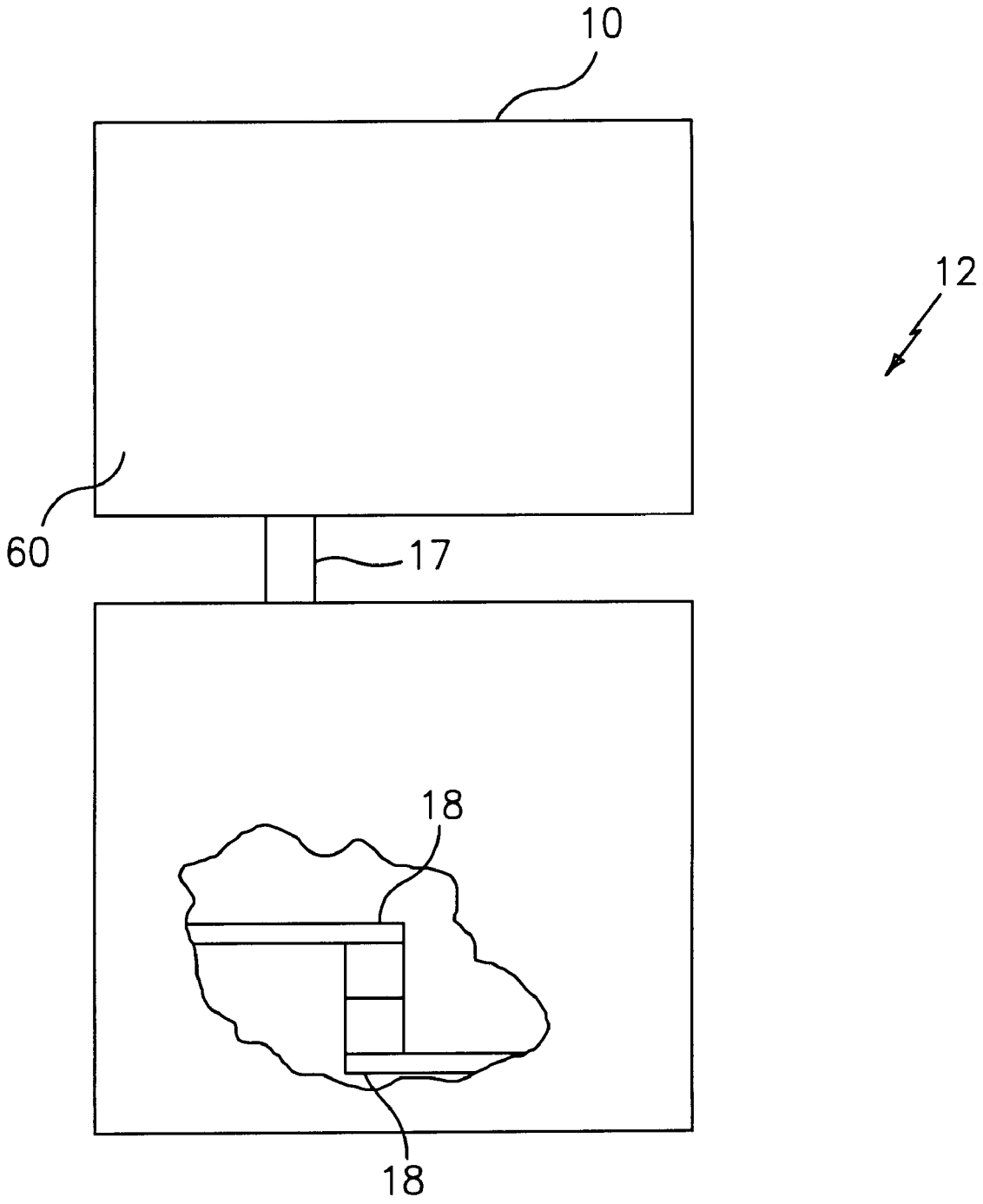
FIG. 1 is a schematic block diagram of a circuit breaker including an auxiliary position switch assembly embodying the present invention.
Figure 2:
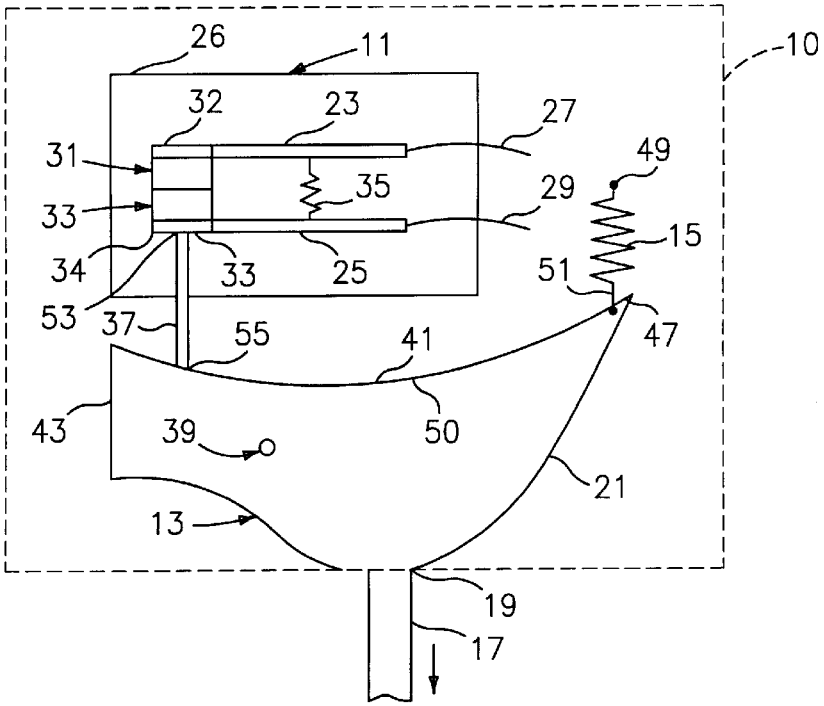
FIG. 2 is a side elevational view of the auxiliary position switch assembly and circuit breaker rod with a normally open auxiliary switch shown in the closed position.

Referring to FIGS. 1 and 2, an exemplary embodiment of an auxiliary position switch assembly is shown generally at 10 in relation to a rod 17 of a circuit breaker 12. The auxiliary position switch assembly 10 comprises an auxiliary switch 11, an actuator 13, and a spring 15, housed within the circuit breaker. The auxiliary switch may be reversed or orientated (either in the field or at time of manufacture) within assembly 10, as will be more fully described below. The switch assembly 10 provides a signal at leads 27, 29 in response to the vertical movement of the rod (or actuator) 17, which is indicative of the position of a pair of separable contacts of the circuit breaker 12.

Figure 3:
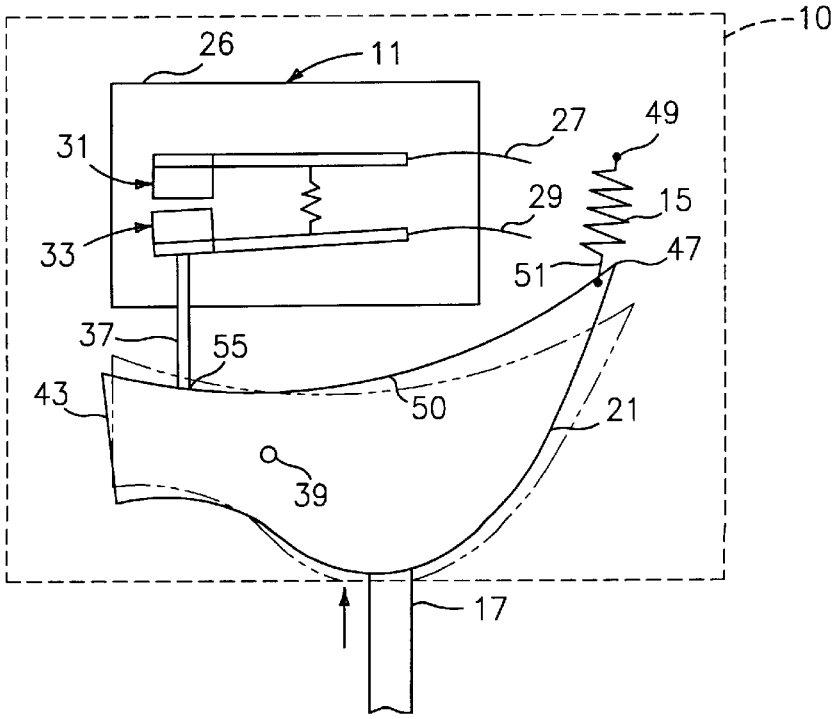
FIG. 3 is a side elevational view of the auxiliary position switch assembly and circuit breaker rod of FIG. 2 with the normally open auxiliary switch shown in the open position.
Figure 4:
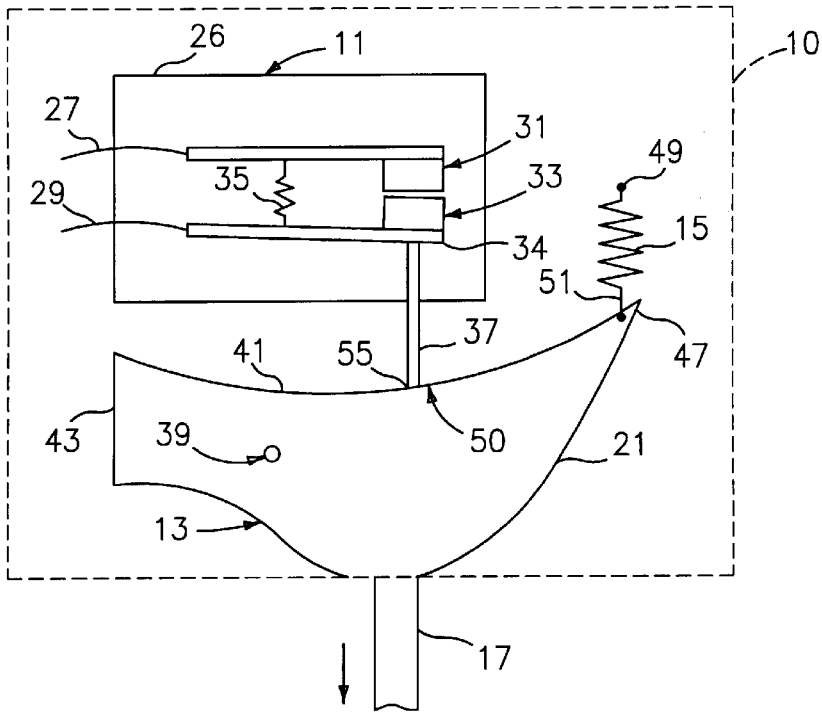
FIG. 4 is a side elevational view of the auxiliary position switch assembly and circuit breaker rod of FIG. 2 with the normally open auxiliary switch rotated 180 degrees shown in the open position.
Figure 5:
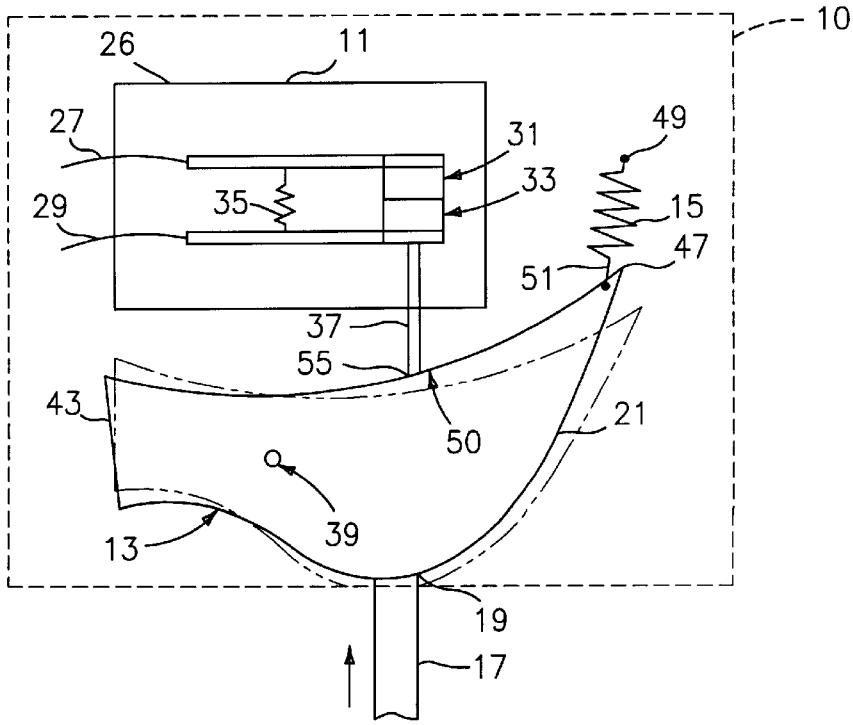
FIG. 5 is a side elevational view of the auxiliary position switch assembly and circuit breaker rod of FIG. 4 with the normally open auxiliary switch shown in the closed position.

The rod 17 is mechanically linked to a separable contact of the circuit breaker 12 by a series of levers and springs (not shown) as is well known in the art. Opening and closing the contacts 18 of the circuit breaker results in vertical movement of the rod 17 between an extended (upward) position, and a retracted (downward) position in accordance with the opening and closing of the contacts of the circuit breaker. The rod 17 slidably engages the actuator 13 to actuate the switch 11 of the auxiliary position switch assembly 10, which will be described in greater detail hereinafter. In the following description of the embodiment of the present invention shown in FIGS. 2–5, the rod 17 is disposed in the extended position, as shown in FIGS. 2 and 4, when the contacts 18 of the circuit breaker 12 are in the closed position. Conversely, the rod 17 disposed in the retracted position, as shown in FIGS. 3 and 5, when of the contacts of the circuit breaker 12 being in the open position.

As best shown in FIG. 2, the auxiliary switch 11 is a normally-open contact switch comprising a fixed contactor 23 and a movable contactor 25 both housed within a switch box 26. A fixed contact 31 is disposed at an end 32 of contactor 23. A movable contact 33 is disposed at an end 34 of contactor 25, opposite the fixed contact 31. A spring 35 biases the movable contactor away from the fixed contactor urging the contacts 31, 33 apart to a normally-open position. The electrical leads 27, 29 are attached to the fixed contactor 23 and the movable contactor 25, respectively. The leads extend through the switch housing or enclosure 26 to provide a signal representative of the position of the contacts 31, 33 of the auxiliary switch 11.

The auxiliary switch 11 further includes a plunger (or actuator) 37 having one end 53 engaging the movable contactor 25, opposing the movable contact 33, and a free end 55 extending through the switch box 26 to slidably engage the actuator 13.

The actuator 13 is this exemplary embodiment has a generally concave upper engagement surface 41 and a convex lower engagement surface 21. The actuator is pivotally mounted to the circuit breaker 12 at pivot 39. However, it is within the scope of the present invention that the actuator 13 be incorporated directly into the circuit breaker 12. While the actuator 13 has been described as having concave and convex surfaces, it will be appreciated that any shaped surface that provides the reverse motion at opposite sides of the pivot 39 may be employed. The pivot 39 is disposed between a first end 43 and second end 47 of the actuator 13 and is offset from the center of the actuator 13 toward its first end 43, which corresponds with the middle (or center) of auxiliary switch 11. The free end 55 of the plunger 37 slidably engages the upper engagement surface 41. The rod 17 of the circuit breaker slidably engages the lower engagement surface 21 of the actuator intermediate the pivot 39 and the second end 47 of the actuator 13.

The actuator 13 is urged clockwise by spring 15, wherein one end 51 of the spring 15 is attached to the second end 47 of the actuator and an opposing end 49 thereof is attached to the housing 60 of assembly 10. However, if the actuator 13 is incorporated directly into the circuit breaker 12 as mentioned above, the spring would then be attached to the circuit breaker 12. The spring 15 maintains constant engagement of the lower engagement surface 21 of the actuator 13 with the rod 17 of the circuit breaker. While the spring 15 is shown to be a helical spring urging the actuator 13 clockwise, one skilled in the art will appreciate that any spring-like member may be disposed at either end of the actuator to bias the same.

Referring now to FIGS. 2 and 3, the auxiliary switch 11 is shown positioned (orientated) in the switch assembly 10 such that assembly 10 operates as a normally-closed switch. As is apparent from these Figures, such is accomplished when plunger 37 engages surface 41 of the actuator 13 at the end 43 side of pivot 39.

As shown in FIG. 2, when the separable contacts 18 (FIG. 1) of the circuit breaker 12 open, the rod 17 moves downwardly. The force of the spring 15 urges the actuator 13 downwardly in a clockwise direction about the pivot 39. The first end 43 of the actuator then forces the plunger 37 of the auxiliary switch 11 upward, against the force of the spring 35, to close the contacts 31, 33. The closed contacts 31, 33 therefore provide a closed circuit between the leads 27, 29 of the auxiliary switch 11, when the circuit breaker contacts 18 are open.

FIG. 3 is illustrative of the position switch assembly 10 when the separable contacts of the circuit breaker 12 are closed. When the circuit breaker contacts 18 (FIG. 1) close, the rod 17 moves upwardly to overcome the force of the spring 15 and pivot the actuator 13 counterclockwise about the pivot 39. The first end 43 of the actuator pivots counterclockwise away from the auxiliary switch 11. The spring 35 of the auxiliary switch 11 urges the plunger 37 downward to maintain contact with the upper engagement surface 41 of the actuator 13, and therefore the contacts 31, 33 of the switch 11 separate when the actuator pivots counterclockwise. The open contacts 31, 33 therefore provide an open circuit between the leads 27, 29 of the auxiliary switch 11, when the circuit breaker contacts 18 are closed.

Referring now to FIGS. 4 and 5, the auxiliary switch is shown positioned (orientated), reversed 180° from that of FIGS. 2 and 3, in the switch assembly 10 such that the switch assembly 10 operates as a normally-opened switch. As is apparent from these FIGS. 4 and 5, such is accomplished when plunger 37 engages surface 41 of the actuator 13 at the end 47 side of pivot 39. In this orientation a portion 50 of surface 41 causes the moveable contact arm 25 of the switch 11 to pivot downwardly to separate (open) the contacts 31, 33 of the switch 11 when the rod 17 of the circuit breaker 12 is in the retracted position. In addition, the moveable contact arm 25 of the switch 11 pivots upwardly to close the contacts of the switch 11 when the rod 17 is in the extended position, as shown in FIG. 5.

As a result, the leads 27, 29 provide an open circuit connection when the contacts 18 (FIG. 1) of the circuit breakers 12 are open, wherein the rod 17 is in the retracted position, as shown in FIG. 4. When the contacts 18 of the circuit breaker 12 are closed, wherein the rod 17 is in an extended position, the leads 27, 29 provide a short circuit connection, as shown in FIG. 5.

As shown in FIG. 4, when the separable contacts 18 (FIG. 1) of the circuit breaker 12 open, the rod 17 moves downwardly. The force of the spring 15 urges the actuator 13 downwardly in a clockwise direction about the pivot 39. The convex portion 50 of the upper engagement surface 41 of the actuator 13 pivots clockwise away from the switch 11. The spring 35 of the switch 11 urges the plunger 37 downward to maintain contact with the upper engagement surface 41 of the actuator 13, and therefore the contacts 31, 33 of the switch 11 separate when the actuator pivots clockwise. The open contacts 31, 33 therefore provide an open circuit between the leads 27, 29 of the auxiliary switch 11, when the contacts 18 of the circuit breaker 12 are open.

FIG. 5 is illustrative of the switch assembly 10 when the separable contacts of the circuit breaker 12 are closed. The rod 17 moves upwardly to overcome the force of the spring 15 and pivot the actuator 13 counterclockwise about the pivot 39. The convex portion 50 of the upper engagement surface 41 of the actuator 13 then forces the plunger 37 upward, against the force of the spring 35 of the switch 11, to close the contacts 31, 33. The closed contacts 31, 33 therefore provide a closed circuit between the leads 27, 29 of the auxiliary switch 11, when the contacts 18 of the circuit breaker 12 are closed.

While the operation of the switch 11 has been described as a normally-open switch, switch 11 may be a normally-closed switch resulting in a reverse configuration for assembly 10, as will be readily apparent to one of ordinary skill in the art.

It will also be appreciated that the present invention provides the ability to configure the auxiliary position switch assembly 10 in the field or in the factory as "normally open" or a "normally closed" switch, to provide a desired output logic thusly, (1) reducing the catalog number requirements and (2) incurring manufacturing economies of scale.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An auxiliary switch assembly for use with a circuit breaker having an actuator which is driven between first and second positions in accordance with the opening and closing of a pair of separable contacts of the circuit breaker, said switch assembly comprising:

a switch having first and second separable contacts with said contacts of said switch being biased to one of a first and second switch position;

a pivotable actuator pivotable between first and second actuator positions, said pivotable actuator having first and second engagement surfaces, said switch being selectively orientated for interacting with said first engagement surface, in a first orientation said contacts of said switch are in said first switch position when said switch interacts with said first engagement surface at one side of a pivot of said pivotable actuator in said first actuator position, in a second orientation said contacts of said switch are in said second switch position when said switch interacts with said first engagement surface at another side of said pivot of said actuator in said first actuator position, said second engagement surface for interacting with the actuator of the circuit breaker to drive said pivotable actuator between said first and second actuator positions and thereby said contacts of said switch.

2. The auxiliary switch assembly of claim 1, wherein said pivotable actuator is biased to one of said first and second actuator positions.

3. The auxiliary switch assembly of claim 2 further comprises:

a spring member position for biasing said pivotable actuator.

4. The auxiliary switch assembly of claim 1, wherein said switch includes a plunger extending therefrom with one end of said plunger engaging said first engagement surface of said pivotable actuator.

5. The auxiliary switch assembly of claim 1, wherein said first engagement surface includes a concave portion.

6. The auxiliary switch assembly of claim 1, wherein said pivot is positioned at about a middle distance relative to said switch.

7. The auxiliary switch assembly of claim 1, wherein the second engagement surface includes a convex portion.

8. The auxiliary switch assembly of claim 1, wherein the separable contacts of the switch are normally-open.

9. The auxiliary switch assembly of claim 1, wherein the separable contacts of the switch are normally-closed.

10. The auxiliary switch assembly of claim 1 with said switch in said first orientation comprises a normally-open auxiliary switch assembly and with said switch in said second orientation comprises a normally-closed auxiliary switch assembly.

11. The auxiliary switch assembly of claim 1 further comprising:

a switch enclosure having said switch disposed therein; and an assembly enclosure having said switch enclosure and said pivotable actuator disposed therein.

12. The auxiliary switch assembly of claim 1 with said switch in said first orientation comprises a normally-open auxiliary switch and with said switch in said second orientation comprises a normally-closed auxiliary switch assembly.

13. The circuit breaker of claim 1 further comprising:

a switch enclosure having said switch disposed therein; and an assembly enclosure having said switch enclosure and said pivotable actuator disposed therein.

14. A circuit breaker comprising:

a pair of separable contacts for interrupting electrical power to a protected load;

an actuator drivable between first and second positions in accordance with the opening and closing said separable contacts; and an auxiliary switch assembly comprising:

a switch having first and second separable contacts with said contacts of said switch being biased to one of a first and second switch position; and a pivotal actuator pivotal between first and second actuator positions, said pivotable actuator having first and second engagement surfaces, said switch being selectively orientated for interacting with said first engagement surface, in a first orientation said contacts of said switch are in said first switch position when said switch interacts with said first engagement surface at one side of a pivot of said pivotable actuator in said first actuator position, in a second orientation said contacts of said switch are in said second switch position when said switch interacts with said first engagement surface at another side of said pivot of said actuator in said first actuator position, said second engagement surface for interacting with the actuator of the circuit breaker to drive said pivotable actuator between said first and second actuator positions and thereby said contacts of said switch.

15. The circuit breaker of claim 14, wherein said pivotable actuator is biased to one of said first and second actuator positions.

16. The circuit breaker of claim 15 further comprises:

a spring member position for biasing said pivotable actuator.

17. The circuit breaker of claim 14, wherein said switch includes a plunger extending there from with one end of said plunger engaging said first engagement surface of said pivotable actuator.

18. The circuit breaker of claim 14, wherein said first engagement surface includes a concave portion.

19. The circuit breaker of claim 14, wherein said pivot is positioned at about a middle distance relative to said switch.

20. The circuit breaker of claim 14, wherein the second engagement surface includes a convex portion.

21. The circuit breaker of claim 14, wherein the separable contacts of the switch are normally-open.

22. The circuit breaker of claim 14, wherein the separable contacts of the switch are normally-closed.

* * * * *